United States Patent [19]

van den Heuvel et al.

[11] 4,020,759

[45] May 3, 1977

[54] METHOD AND APPARATUS FOR MARKING A WEB

[75] Inventors: Eeuwoud van den Heuvel, Helmond; Huibert Peter Reinhold, Eindhoven, both of Netherlands

[73] Assignee: Vlisco B.V., Netherlands

[22] Filed: Mar. 31, 1975

[21] Appl. No.: 563,451

[30] Foreign Application Priority Data

Apr. 18, 1974 Netherlands ..... 7405267

[52] U.S. Cl. ..... 101/328; 346/78; 401/265

[51] Int. Cl.[2] ..... B41F 31/08

[58] Field of Search ..... 101/327, 328, 331; 33/34–38, 127–129, 141 E; 401/180, 219, 265; 346/78, 140; 197/1 R

[56] References Cited

UNITED STATES PATENTS

| | | | |
|---|---|---|---|
| 1,782,681 | 11/1930 | Foss et al. | 401/265 |
| 1,804,359 | 5/1931 | MacDonald | 101/115 |
| 1,919,887 | 7/1933 | Gleeson | 401/180 |
| 2,495,179 | 1/1950 | Paul | 401/265 X |
| 3,006,273 | 10/1961 | Sommer | 33/141 E X |
| 3,054,109 | 9/1962 | Brown, Jr. | 401/265 X |
| 3,086,460 | 4/1963 | Denning | 33/36 |
| 3,108,673 | 10/1963 | Green | 197/1 R |
| 3,329,964 | 7/1967 | Mutschler et al. | 346/140 X |
| 3,683,212 | 8/1972 | Zoltan | 346/140 X |
| 3,783,785 | 1/1974 | Frank et al. | 101/328 |

FOREIGN PATENTS OR APPLICATIONS

| | | | |
|---|---|---|---|
| 465,658 | 9/1951 | Italy | 401/180 |

*Primary Examiner*—Edgar S. Burr
*Assistant Examiner*—R. E. Suter
*Attorney, Agent, or Firm*—Cushman, Darby & Cushman

[57] ABSTRACT

A method and apparatus for applying viscous liquid marking substance in which the marking substance is applied in small amounts at spaced-apart locations to a moving web from the open mouth of a narrow channel which intermittently contacts the web, the marking substance passing from a supply thereof into and filling the channel and being collected there during the intervals between successive contacts of the chanel mouth with the web.

9 Claims, 3 Drawing Figures

METHOD AND APPARATUS FOR MARKING A WEB

The present invention relates to a method and apparatus for providing a web with a marking substance in relatively spaced apart positions by applying quantities of the substance in viscous condition to the web.

In successive operations on a web, for example printing a fabric web in which the patterns to be printed are related to each other, it is necessary to accurately determine the location of the result of a preceding operation. To this end the web should be perceptibly marked in certain positions. For example, it is possible to mark a fabric web with a ferromagnetic substance. As such markings must be capable of sustaining washing and rinsing operations taking place between the several operations, a certain resistance of the marking is essential, and as a result of this resistance the ultimate removal of the marking is difficult. By making the marking very small, so that the appearance of the web is not appreciably altered by the presence of the marking, removal of the marking will not be necessary.

When applying a marking the viscosity of the marking substance plays an important part. If a ferromagnetic marking substance is chosen this involves the application of a suspension having a very high percentage of iron and hence a very high viscosity. This high viscosity renders accurate application of small quantities of the suspension difficult, particularly as the marking should preferably be applied to the web at the usual speed of the web during printing, for example 2 m/sec.

The object of the invention is to provide a method with which the required small quantities of a marking substance can accurately be applied to a rapidly travelling web. marking substance is applied in small amounts at spaced-apart locations to a moving web from the open mouth of a narrow channel which intermittently contacts the web, the marking substance passing from a supply thereof into and filling the channel and being collected there during the intervals between successive contacts of the channel mouth with the web.

In order to adjust the issuing quantity of substance accurately, according to the invention, it is possible to keep the substance supply under excess pressure. To prevent premature evaporation of a solvent, if any, from the substance, it is possible, according to the invention, to keep the substance supply under a pulsatory excess pressure, thus adjusting the latest possible issuance of the substance through the channel mouth.

The invention also relates to an apparatus for applying the marking substance, comprising guide means for guiding the web and means for applying the markings, which apparatus includes one or a number of channel mouths moving along periodically with and against the web, so that at least partly in the periods when the channel mouths are out of contact with the web the substance can collect in the channel mouth.

The periodic movement of the channel mouth with and against the web can be effected, for example, by attaching a storage container for the substance, provided with an outlet channel and a channel mouth, to an endless chain which travels a path running partly parallel to the path of the web.

Alternatively the intermittent movement of the channel mouths into engagement with the web can be effected by providing the storage container and channel in a roller so that the channel mouth is located at the surface of the roller.

The supply of substance can be disposed, according to another feature of the invention, in a storage container to be mounted removably in the roller, said container essentially consisting of a hollow, cylindrical housing closed at one end except for a channel, in which housing a piston is mounted to define a compartment for the substance.

In order that after filling of the storage container the piston is mounted in such a manner that no air is present in the compartment, the piston according to the invention may be provided with a closable, axial ventilating duct. It will be evident that air present in the compartment for the substance will adversely influence the operation of the apparatus when after a period of non-operation, during which the storage container is located at the top of the roller, the air has moved upwards, that is to say, to the outflow channel.

The excess pressure in the compartment for the substance can be brought about in various ways. By rotation of the roller a centrifugal force will be exerted on the substance and the piston in the direction of the channel mouth. This centrifugal force can be combined with a force produced by a spring mounted behind the piston, the tension of the spring being adjustable. To simply adjust the excess pressure and change it periodically, if necessary, a pressurizing fluid can be supplied behind the piston.

In accordance with the invention the hollow, cylindrical housing may to this end be provided at the end directed away from the roller surface with a plug having a channel extending axially of the plug. This axial channel serves for the supply of the pressurizing fluid behind the piston, so that the substance can be pressed to the roller surface, possibly by a pulsatory pressure behind the piston.

If the roller has a hollow construction, the pressurizing fluid can be present in the interior of the roller. In accordance with a feature of the invention it is also possible to provide each storage container with a pressurizing fluid supply line connectable to the plug. Compressed air is the preferred pressurizing medium.

With a view to proper transfer of the substance to the web it is important that the channel mouth, where previously an accumulation of the substance has formed, is for a predetermined period of time in contact with the web, depending on the composition of the substance and other conditions. In order to adjust this period of time the roller can be arranged for displacement in a direction normal to its axis, so that the embracing angle of the web about the roller is adjustable.

The invention will now be described further with reference to the drawing showing an embodiment of the apparatus for applying a marking.

Figure 1:
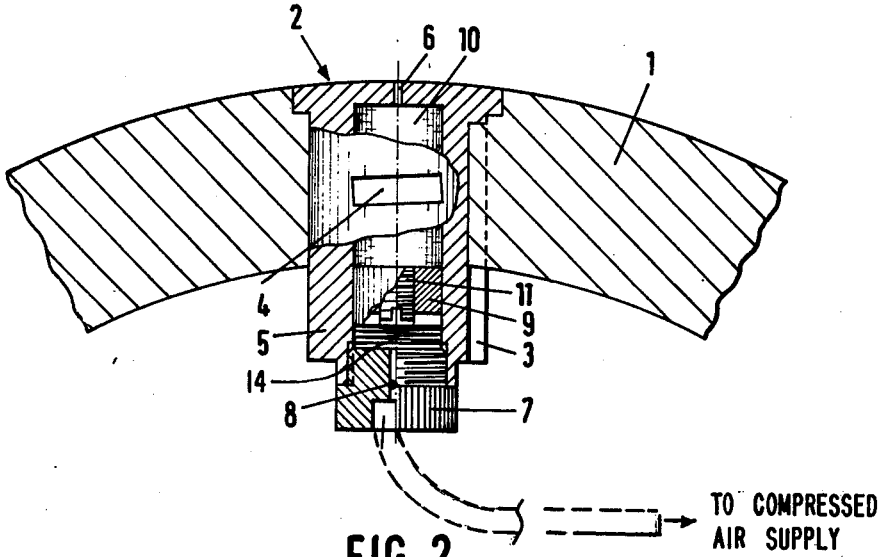
FIG. 1 shows part of a section of a rotary roller at the storage container for the substance.

In FIG. 1 a rotary roller 1, which is hollow in this embodiment, is provided with a recess in which a storage container 2 for the marking substance is accommodated. The storage container 2 includes a keyseat 3 which corresponds with a key, whether or not integrally connected to the roller, to keep the storage container in the right position with respect to roller 1. Accommodation of storage container 2 in roller 1 can be effected by rotating or sliding rotary keys, not shown, in the substantially tangential slots 4. Slots 4 form a small angle with the plane perpendicular to the axis of storage container 2 in order to clamp it in the roller.

Figure 2:
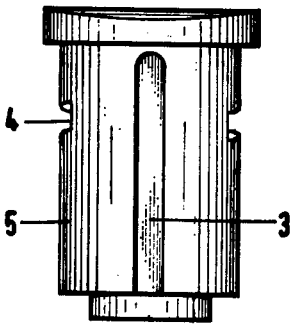
FIG. 2 is a side elevational view of the housing of the storage container.
Figure 3:
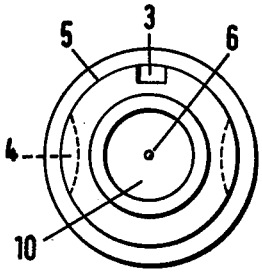
FIG. 3 is a bottom view of the housing of the storage container.

Storage container 2 comprises a hollow, cylindrical housing 5 (FIGS. 2 and 3), closed at one end except for a channel 6, the outer surface of said closure conforming with the circumferential configuration of roller 1, so that the outer surface of roller 1 is not interrupted, except for channel 6.

Housing 5 of the storage container has on its end opposite the roller surface a plug 7 screwed therein, said screw having an axial channel 8. The cylindrical space in storage container 2 is divided into two compartments by means of a piston 9. Compartment 10, connected via channel 6 to the outer surface of the roller, is adapted to be filled with the marking substance. After filling, the screw 11 in piston 9 can be turned out opening an axial ventilating duet in piston 9, so that the air still present in compartment 10 can escape.

Behind piston 9 a pressure can be provided, for example by means of a spring 14, or by means of compressed air present in the hollow space of roller 1. It is also possible to connect a compressed air line, as shown in phantom lines at recess 12 in plug 7.

It will be clear that the invention is not limited to the embodiment given, but that variations and other constructions are also covered by the invention.

We claim:

1. Apparatus for applying viscous liquid marking substance to a moving web at spaced-apart locations comprising: a roller; at least one removable hollow cylindrical storage container in the roller, said container having one end exposed at the surface of the roller and conforming with the outer circumferential configuration of said roller, said container being provided with a narrow unobstructed channel extending between the interior of said container and an open mouth located on the end of said container exposed at the surface of the roller; a piston slidably mounted in said container forming a chamber for the marking substance between said piston and said one end of the container; and pressure means for closing the other end of said container and for applying pressure to the liquid marking substance within the interior of said container.

2. Apparatus as in claim 1 wherein the piston has a closeable ventilating duct extending between the opposite ends of the piston.

3. Apparatus as in claim 1 wherein the pressure means comprises a plug having a channel extending therethrough into communication with the space between the piston and said other end of the storage container.

4. Apparatus as in claim 3 wherein said plug includes a connection for connecting a fluid pressurizing medium to the channel in said plug.

5. Apparatus for applying viscous liquid marking substance to a moving web at spaced-apart locations comprising: a roller; at least one removable hollow cylindrical storage container in the roller, said container having one end exposed at the surface of the roller and conforming with the outer circumferential configuration of said roller, said container being provided with a narrow unobstructed channel extending between the interior of said container and an open mouth located on the end of said container exposed at the surface of the roller; piston means slidably retained within the interior of said container for dividing the interior of said container into two compartments and for directly applying pressure to the marking substance, plug means for closing said other end of said container and means for applying pressure to said piston means.

6. A marking apparatus as in claim 5 wherein said piston means includes ventilating means for allowing air trapped within the interior of said container during filling to escape.

7. A method of applying a viscous liquid marking substance to a moving web at spaced-apart locations by using a marking device having a reservoir for holding a supply of a viscous marking substance, a channel connecting the reservoir with the exterior of the device wherein the channel is provided with a mouth at the exterior surface of the device and a source of pressure for pressurizing the viscous marking substance retained in the reservoir said method comprising the steps of bringing the marking device into contact with the web; rotating the marking device by creating relative movement between the marking device and the web so that during each complete revolution of the marking device the mouth of the channel is out of contact with the web for a first period of time and in engaging contact with the web for a second period of time; forming a predetermined quantity of viscous marking substance exteriorly of the mouth during the first period of time; and subsequently applying the entire quantity of the marking substance formed exteriorly of the mouth to the web during the second period of time.

8. A method as in claim 7 wherein the supply of viscous liquid marking substance is maintained under contact pressure.

9. A method as in claim 7 wherein the supply of viscous liquid marking substance is subjected to pulsating pressure.

* * * * *